United States Patent [19]

Downing

[11] 4,442,939

[45] Apr. 17, 1984

[54] LONGITUDINALLY-SEAMED ASSEMBLY OF SLEEVE MARKERS

[75] Inventor: Gerald T. Downing, Port Washington, Wis.

[73] Assignee: W. H. Brady Co., Milwaukee, Wis.

[21] Appl. No.: 385,426

[22] Filed: Jun. 7, 1982

[51] Int. Cl.[3] ..... B65D 85/20; B65D 63/00

[52] U.S. Cl. ..... 206/345; 206/390; 206/820

[58] Field of Search ..... 206/343, 345, 390, 820; 229/48 T

[56] References Cited

U.S. PATENT DOCUMENTS 885,778 4/1908 Neuberger ..... 206/820
2,335,159 11/1943 Salfisberg ..... 229/48 T
3,179,284 4/1965 Valyi ..... 206/390
4,173,837 11/1979 Kiejzik ..... 206/390

*Primary Examiner*—William T. Dixson, Jr
*Assistant Examiner*—Brenda J. Ehrhardt
*Attorney, Agent, or Firm*—Quarles & Brady

[57] ABSTRACT

An assembly (1) of tubular sleeve markers (2) made with two webs (3, 4) joined together by longitudinal seams (5, 5*a* and 5*b*) and having transverse severance lines (13); a row of transverse apertures (12) is defined in at least one of the webs. An individual sleeve marker has closed edge portions (6 and 7) formed as parts of an adjacent pair of longitudinal seams and open end portions (17 and 18) formed as parts of an adjacent pair of transverse severance lines, with a portion (12*a*) of a transverse aperture along at least one of its open ends.

6 Claims, 12 Drawing Figures

LONGITUDINALLY-SEAMED ASSEMBLY OF SLEEVE MARKERS

TECHNICAL FIELD

This invention relates to sleeve markers of tubular structure useful for identifying various types of objects, such as electrical wires, for example.

BACKGROUND ART

Tubular sleeve markers are slipped over an object for use as an identification device, and the markers may be color-coded or carry alpha-numeric indicia in order to provide the required identification information. A typical use of sleeve markers is to provide individual identification of each electrical wire in a group of wires arranged together in a harness or bundle.

One form of prior art tubular sleeve marker is made from plastic tubing cut into sleeves of the desired length. The tubing may be made of heatshrinkable or non-heatshrinkable material, depending upon the intended end use. Sleeve markers of this type usually are supplied to the customer as a package of individual sleeves, but this has a disadvantage in that a user cannot apply specific identification information to the sleeves at the time they are to be applied to an object. One solution to this problem is that described in U.S. Pat. No. 3,894,731. Flattened sleeves are carried on tines extending from a supporting spine. This construction, however, requires modified or special printing equipment to enable a user to apply alpha-numeric indicia to the sleeves and also is a relatively high cost sleeve marking system. Another prior art sleeve marker was sold in the form of a large assembly (11"×14") consisting of two sheets of vinyl films of equal width sealed together with spaced horizontal seals to form a three-dimensional structure of long sleeves that a user was to cut into sleeves of the desired length; the product met with limited acceptance as it was cumbersome and inconvenient for a customer to use.

More recent developments are described in U.S. patent applications Ser. No. 306,045 now U.S. Pat. No. 4,363,401 (Savagian) and Ser. No. 306,044, now U.S. Pat. No. 4,361,230 (Downing, Stepanski and Wirth), both owned by the assignee of this application, which disclose sleeve marker products having advantages not found with the abovementioned prior art products.

DISCLOSURE OF THE INVENTION

My present invention comprises an assembly of tubular sleeve markers made from two webs of flat flexible film material. The two webs are joined together along spaced longitudinal seams, and transverse severance lines extend across the webs. Tubular sleeve markers are defined between each adjacent pair of longitudinal seams and transverse severance lines. Individual sleeve markers are detachable from the assembly along the longitudinal seams and transverse severance lines.

One of the webs of the assembly is wider than the other to have marginal longitudinal edge portions extending beyond each of the opposed edges of the other web, and a row of spaced apertures may be formed in each of the edge portions of such web so that the assembly can be fed through printing equipment incorporating a sprocket drive to thereby facilitate the printing of serial or customized identification information on each sleeve marker.

The longitudinal seams may be formed by various techniques, including for example heat sealing and sonic sealing techniques. An advantage of the present construction is that it can be made with longitudinal seams formed by mechanical means such as sewing machines, thereby enabling an assembly of sleeve markers to be made from film materials which cannot be readily seamed by heat sealing or sonic sealing methods. The present concept, thus, can extend the range of materials which can be used to produce an assembly of sleeve markers.

The present assemblies are in flat condition when supplied to a user so that they can be conveniently fed through various types of printing equipment. Each sleeve marker in an assembly can be printed with selected information, after which an individual sleeve marker is detached from the assembly for application to an object while the remaining sleeve markers are retained as part of the assembly and available for later use.

BEST MODES FOR CARRYING OUT THE INVENTION

I. Description of FIGS. 1-9

(a) Structural Description

Figure 1:
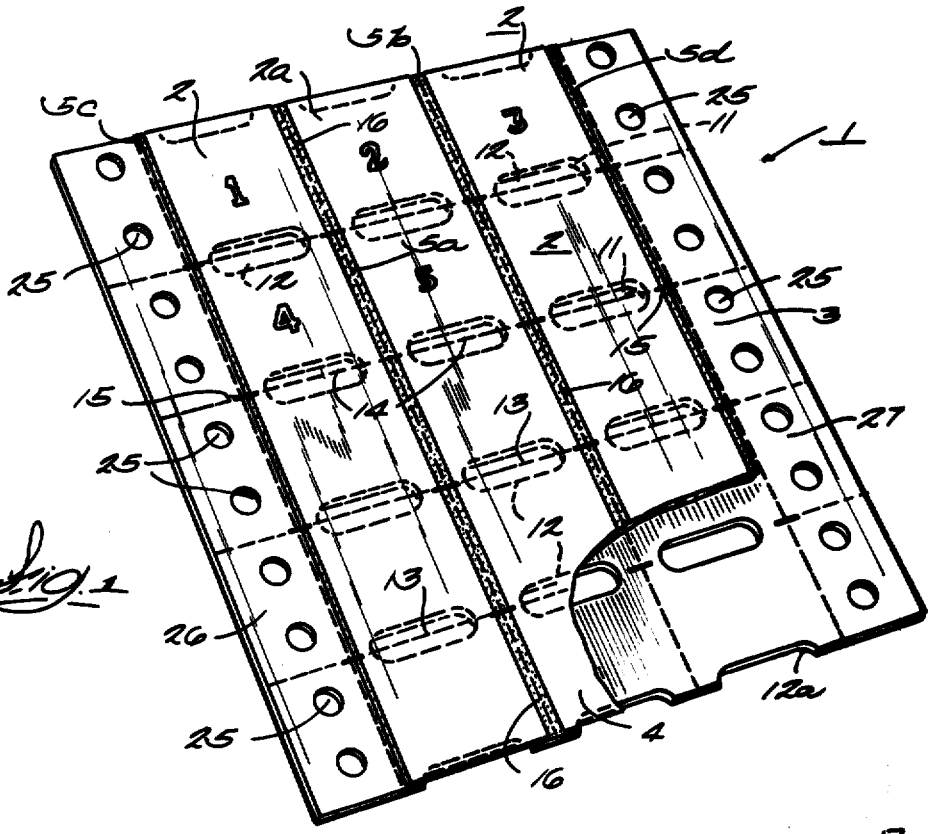
FIG. 1 is a perspective view, with a portion broken away, of an assembly of tubular sleeve markers made in accordance with the present invention.

FIG. 1 illustrates an assembly 1 consisting of an array of individual tubular sleeve markers 2 detachably joined together in an end-to-end relationship. As discussed in greater detail below, each sleeve marker is to be individually separable from the assembly when it is to be applied to an object while the non-detached sleeve markers remain as part of the assembly. The assembly 1 is illustrated in sheet-form, but it may also be made in roll-form or as a fan-folded group of flat sheets joined together at their ends.

The assembly 1 of sleeve markers is made with a web 3 and a web 4 that are joined together along a plurality of spaced, parallel longitudinal seams 5. The webs 3 and 4 are joined together only along the longitudinal seams. Each sleeve marker 2 has opposed closed edge portions 6 and 7 (see sleeve marker 2a in FIGS. 1 and 2) that are defined by an adjacent pair of longitudinal seams. The longitudinal seams are spaced apart from one another at selected intervals or distances as required to define individual sleeve markers of the desired circumferential size. One-half of a sleeve marker is made from a portion of the web 3 between adjacent spaced longitudinal seams and the other half is made from a superposed portion of the web 4 between the same pair of spaced longitudinal seams.

As depicted in FIG. 1, the webs 3 and 4 are arranged in face-to-face relationship with the longitudinal axis of the web 3 positioned parallel to the longitudinal axis of the web 4. The longitudinal seams 5 are parallel to the longitudinal axes of the two webs.

Spaced rows 11 of transverse apertures 12 are formed across at least one of the webs, the web 3 in the exemplary embodiment. There is at least one aperture 12 positioned between each adjacent pair of longitudinal seams 5. The apertures 12 are illustrated as being formed with flat sides and curved end portions, although other shapes may be used such as round (see FIG. 9), square or rectangular apertures. The apertures 12 are most readily formed by die cutting when using plastic film for the web material. The purpose of the apertures will be explained below.

Transverse severance lines 13 are formed through both the webs 3 and 4 and intersect each aperture 12, preferably along the transverse center line of each aperture as illustrated in the drawings. The severance lines 13 may be made in various configurations, such as rows of spaced slits, circular perforations, etc., that will enable manual separation of the webs along a severance line. A useful form of severance line 13 is illustrated in the drawings as comprising a row of spaced slits 14, with a slit 15 extending across each longitudinal seam 5 so as to enable severance along a seam without impairing its structural integrity. The transverse severance lines should extend between at least the two outer longitudinal seams, 5c and 5d, but may extend entirely across both webs as illustrated in the drawings.

An individual sleeve marker 2 is to be manually detachable from the assembly 1. In order to facilitate this, the longitudinal seams 5 may include a weakened zone 16 extending centrally of the interior seams 5a and 5b and extending along an outer edge of the outer seams 5c and 5d as illustrated. The weakened zones 16 may be of various constructions, including a line of perforations or row of slits, and an effective construction is described below in part (b).

Figure 2:
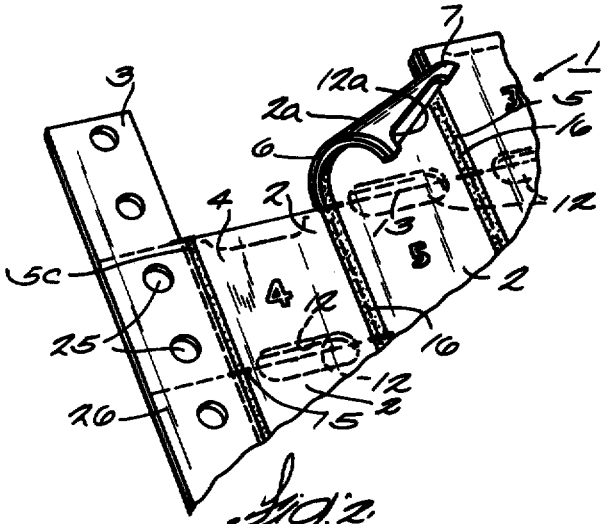
FIG. 2 is a perspective view of a portion of the assembly of FIG. 1 illustrating one of the sleeve markers partially detached from the assembly.
Figure 3:
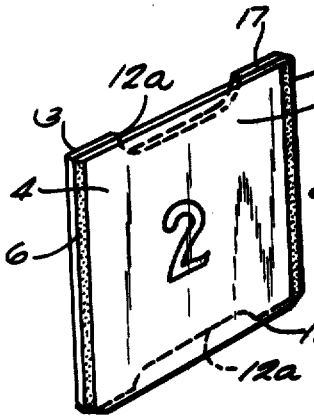
FIG. 3 is a perspective view of an individual sleeve marker fully detached from the assembly of FIG. 1.
Figure 4:
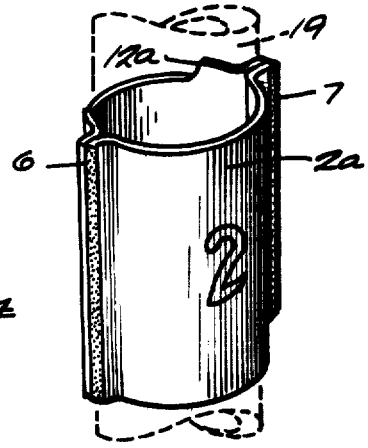
FIG. 4 is a perspective view of the sleeve marker of FIG. 3 inserted onto a wire for identification purposes.

FIG. 2 illustrates sleeve marker 2a in the process of being manually detached from the assembly. After being detached along spaced longitudinal seams 5 up to severance line 13, the sleeve marker 2a is then separated along the severance line until it is fully detached from the assembly 1. As can be seen in FIG. 3, a sleeve marker 2a has opposed closed edge portions 6 and 7 formed as part of an adjacent pair of longitudinal seams 5. The sleeve marker 2a also has open ends 17 and 18 defined by portions of the webs 3 and 4 along a severance line 13 or an end of the assembly, as the case may be. As further indicated in this drawing, a portion 12a of an aperture 12 is disposed along each open end 17 and 18 of the marker sleeve 2a. The sleeve marker 2a is ready to be inserted along the wire or other object to be identified as illustrated in FIG. 4. The part of the web 4 overlying or extending across an aperture portion 12a facilitates insertion of the sleeve onto a wire as an end of a wire 19 can be placed alongside of this portion of the web 4 and slightly pushed against it so as to open up the sleeve. The marker is then moved along the wire 19 to its final desired position as shown in FIG. 4. Also, an appropriately shaped tool can be pressed against the portion of the web 4 overlying an aperture portion 12a to aid in inserting a wire through a sleeve marker.

A row of evenly spaced apertures 25 is formed within the marginal longitudinal edge portion 26 of the web 3 which extends beyond the adjacent longitudinal edge of the web 4. A similar row of apertures 25 is formed in the marginal longitudinal edge portion 27 of the web 3 that extends beyond the opposite longitudinal edge of the web 4. When utilized in the assembly 1, the apertures 25 are intended for engagement with a web sprocket drive such as associated with line printers used with word processing equipment and computers. This enables automatic equipment to be employed to print suitable alpha-numeric indicia on the individual tubular sleeve markers 2. Users of sleeve markers often have a need to custom print a large number of sleeves with sequential or coded identification numbers, and the assembly 1 is suitable for such purposes.

Each of the sleeve markers 2 can carry an appropriate alpha-numeric identification legend on one or both of its surfaces, such as the sequential numeric legends illustrated on the top webs of the markers in FIGS. 1–4. The legends can be applied by the user of the assemblies 1 with suitable equipment such as described above, or pre-printed by the manufacturer. The legends or other identification indicia can be applied by printing, hot stamping, embossment, typing, writing, or other appropriate techniques. Also, the markers can be supplied in various solid colors or stripes, with or without indicia, when desired for a particular identification use.

(b) Longitudinal Seam Formation

Figure 5:
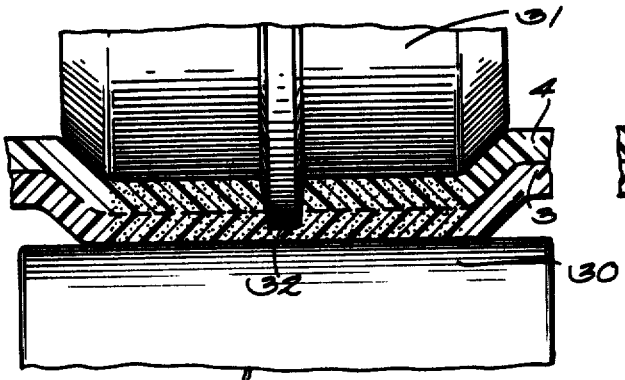
FIG. 5 is a partial sectional view illustrating one type of apparatus suitable for forming the longitudinal seams of the assembly of FIG. 1.
Figure 6:
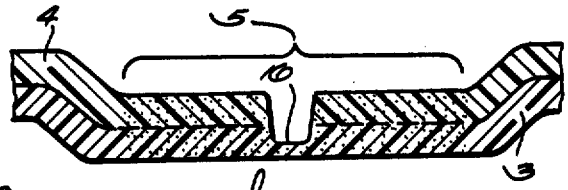
FIG. 6 is a sectional view of a longitudinal seam formed with the apparatus of FIG. 5.

FIG. 5 illustrates a particularly useful apparatus and method for making the longitudinal seams 5, and FIG. 6 illustrates a seam formed thereby. Referring first to FIG. 5, the webs 3 and 4 are positioned between the horn 30 and anvil 31 of a suitable ultrasonic welding or sealing machine (not shown). The ultrasonic welding machine may be selected from a wide variety of commercially-available ultrasonic welding machines, e.g. machines sold by Branson Sonic Power Company of Danbury, Conn. The anvil 31 carries a seaming die 32 which has a narrow or knife edge projecting from its frontal face that contacts the web 4. After the webs are positioned as shown in FIG. 5, either the horn 30 or anvil 31 is raised or lowered to engage the webs firmly, generally using air pressure to hold the webs in the desired position. The ultrasonic power source of the apparatus is then energized for a time sufficient to seam the two webs together. The seam formed with the ultrasonic sealing means of FIG. 5 is shown in FIG. 6. A longitudinal seam 5 joins the web 4 to the web 3. A weakened zone 16 is formed centrally of the seam 5 simultaneously with the formation of the seam due to the shape of the sealing die 32. The zone 16, which is a necked-downed or thinned-out portion of the webs 3 and 4, forms a longitudinal separation line or weakened area along which a longitudinal seam can be separated manually so that an individual sleeve marker is detachable from the assembly. Ultrasonic sealing is particularly effective for making the longitudinal seams in the assembly 1 because a narrow seam of high strength can be made, such as on the order of 0.010" to 0.030" wide.

Figure 7:
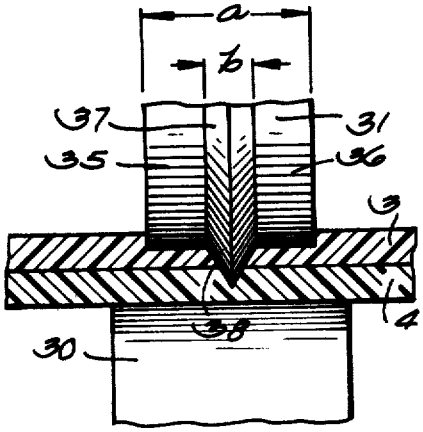
FIG. 7 is a partial sectional view illustrating another form of apparatus suitable for making the longitudinal seams of the assembly of FIG. 1.
Figure 8:
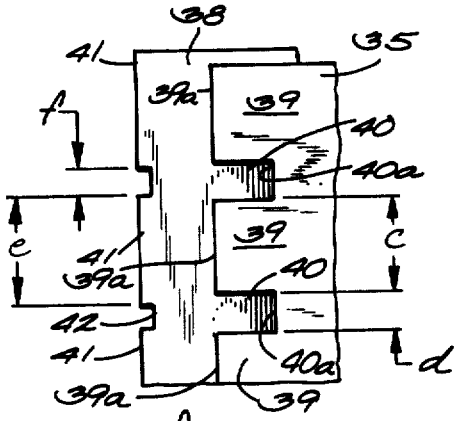
FIG. 8 is a side view of part of the apparatus illustrated in FIG. 7.

Another form of seaming die for use with ultrasonic sealing equipment is illustrated in FIGS. 7 and 8. The anvil 31 carries a seaming die having first and second outer sealing elements 35 and 36 between which is positioned a knife-shaped sealing element 37 having a V-shaped lower edge 38. The elements 35, 36 and 37 have a combined width "a" and the element 37 has a width "b". Referring now to the plan view of FIG. 8, each outer sealing element 35 and 36 has a series of spaced seaming teeth 39 separated from one another by notches 40, the notches having an upper surface 40*a* spaced above the lower surface 39*a* of each seaming tooth. Each tooth has length "c" and each notch length "d". The inner sealing element 37 has its lower edge serrated or notched as shown in FIG. 8 to have sealing teeth 41 separated by notches 42, with each tooth having length "e" and each notch length "f".

Figure 9:
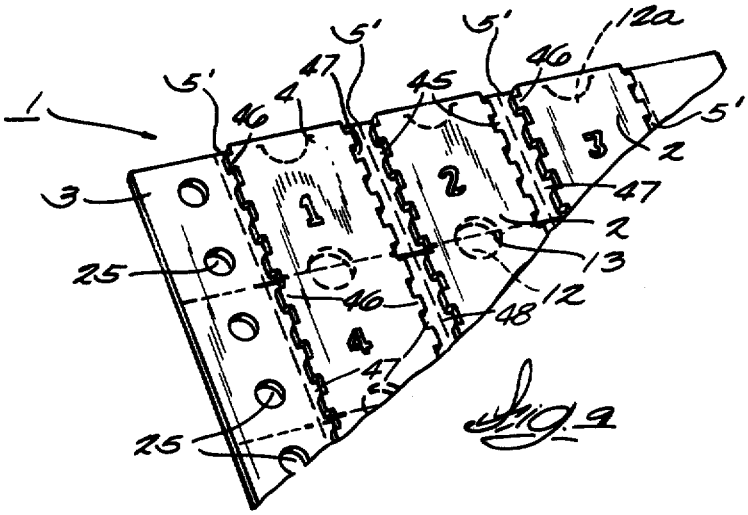
FIG. 9 is an enlarged perspective view, with portions broken away, of a part of an assembly having longitudinal seams made with the apparatus of FIGS. 7 and 8.

FIG. 9 illustrates the assembly 1 made with longitudinal seams 5' formed with the seaming die of FIGS. 7 and 8. A seam 5*a* consists of a row of spaced seamed areas 45 separated by lands 46. The seamed areas 45, which are larger than the lands 46, are formed by the teeth 39 of the elements 35 and 36 of the seaming die to have dimensions "a" by "c"; with dimension "a" extending longitudinally of the webs and dimension "c" extending transversely of the webs. The lands 46 are largely unseamed portions of the webs 3 and 4 and have dimensions "b" by "d", with dimension "b" extending longitudinally of the webs and "d" extending transversely of the webs. Each seamed area 45 has a central depressed zone 47; a groove 48 extends across each zone 47 and has its ends terminating within a land 46. The grooves 48 are formed by the teeth 41 of the element 37 of the seaming die. It is difficult to illustrate the finished seams 5' in the drawings, but there is some plastic flow of the webs 3 and 4 between their adjoining faces and also some plastic flow within at least a portion of the lands 46. The seamed areas 45 are formed as a series of small depressed sealed areas extending across each longitudinal seam. It has been found that a seam 5' of the illustrated construction has a higher strength than the seam 5 illustrated in FIGS. 1–4. Specifically, with seams of equal width and using the same web material, it was found that the seam 5' had a pull strength (measured on an Instron apparatus) that more closely approached the film strength of the two webs that were seamed together and was on the order of twice the strength of the seam 5. This feature provides a sleeve marker which is capable of withstanding more rigorous applications than the previous seam construction. At the same time, it was noted that the seam 5' was easy to separate manually so that an individual marker 2 can be removed from the assembly.

The seaming dies illustrated in FIG. 5 and FIGS. 7 and 8 may be flat dies that are reciprocated to form portions of the longitudinal seams each time the sealing apparatus is actuated or rotary dies that form the longitudinal seams in a continuous manner.

(c) Materials

The webs 3 and 4 are to be flexible sheet materials. Useful materials include flexible thermoplastic films such as polyester films, acrylate films, vinyl films, nylon films and polyolefin films such as polyethylene and polypropylene. One or both of the webs may also be paper, particularly paper having a polyethylene coating so as to be ultrasonically sealable or heat sealable. Both webs may be the same material, or dissimilar materials if more suitable for a particular end use. The specific flexible sheet material for making an assembly 1 should be selected to provide the properties considered necessary for a particular end-use, such as temperature resistance, flame retardancy, solvent resistance, etc. Either web, or both, can be a heatshrinkable film or non-heatshrinkable film. Many of these film materials are inherently sealable ultrasonically or by heat sealing or dielectric means but, if not, suitable sealable coatings can be applied to the facing surfaces of the webs that will be joined together to form the longitudinal seams 5. The printability of the materials for the webs should also be considered; if a user is to apply identifying alphanumeric information to individual sleeve markers such as with a line printer or typewriter, the material for at least one of the webs should either be inherently printable or coated with a printable coating in order to provide the desired printability functionality.

II. Description of FIGS. 10 and 11

Figure 10:
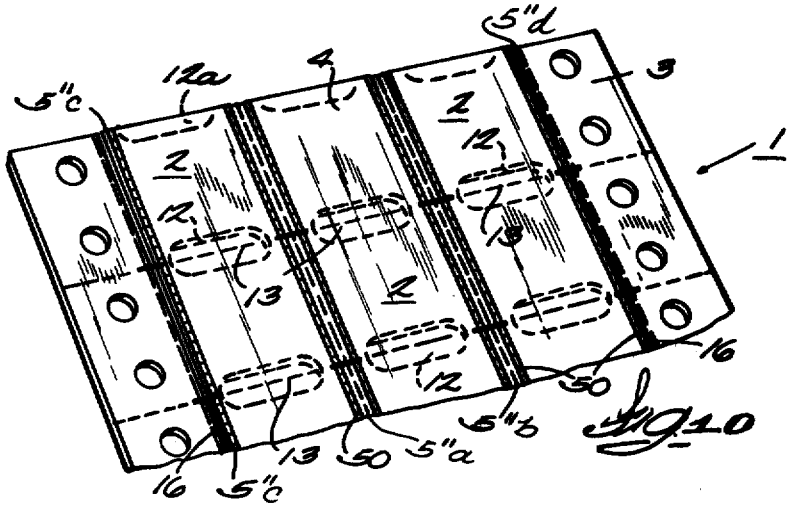
FIG. 10 is a perspective view with portions broken away of another embodiment of an assembly of tubular sleeve markers according to the present invention.
Figure 11:
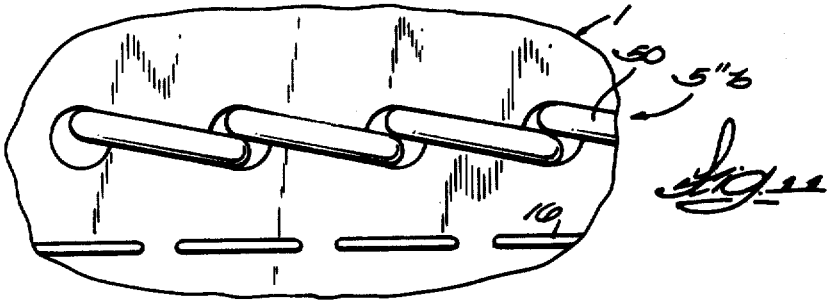
FIG. 11 is a perspective view of a portion of the assembly of FIG. 10.

FIG. 10 illustrates another embodiment of the assembly 1 of sleeve markers 2 which differs from the prior embodiments in having stitched longitudinal seams 5" joining the webs 3 and 4 together, and FIG. 11 is a close-up plan view of a portion of an interior seam 5".

The longitudinal seams 5" are formed by sewing together the two webs with thread such that the two interior seams 5"*a* and 5"*b* of the assembly are formed of two spaced rows of sewn thread 50 and the two outer seams 5"*c* and 5"*d* are formed of one row of sewn thread 50. Positioned between the rows of thread 50 of the two interior longitudinal seams is a longitudinal separation line 16, illustrated as a series of spaced slits or perforations; a similar separation line 16 is formed in the web 3 just outboard of the row of thread 50 of the two outer longitudinal seams of the assembly. The separation lines 16 may be formed simultaneously with the stitching together of the two webs by the rows of thread 50, or just after the sewing has been completed. The seams 5" can be sewn with any suitable industrial sewing equipment, utilizing a separate sewing head for each row of thread 50. The seams are most usefully made by sewing the webs together with threads of heat resistant material sized with a thermoplastic coating, and then advancing the assembly through an oven so as to fuse or set the threads with heat.

The assembly 1 as illustrated in FIGS. 10 and 11 can be made with any of the film materials discussed above under part (c). However, an advantage of the stitched longitudinal seams 5" illustrated in these two drawings is that the assembly also can be manufactured of plastic film materials that cannot be easily ultrasonically sealed or heat sealed in order to form the longitudinal seams. This includes plastic films such as fluorinated ethylene-propylene copolymer films (such as available under the tradename "Tedlar"), non-woven polyimide webs (such as available under the tradename "Nomex"), some polyester films, and polyimide films (such as available under the tradename "Kapton"). Films of this nature are especially useful for applications in which a sleeve marker capable of resisting high temperature conditions is required.

III. Description of FIG. 12

Figure 12:
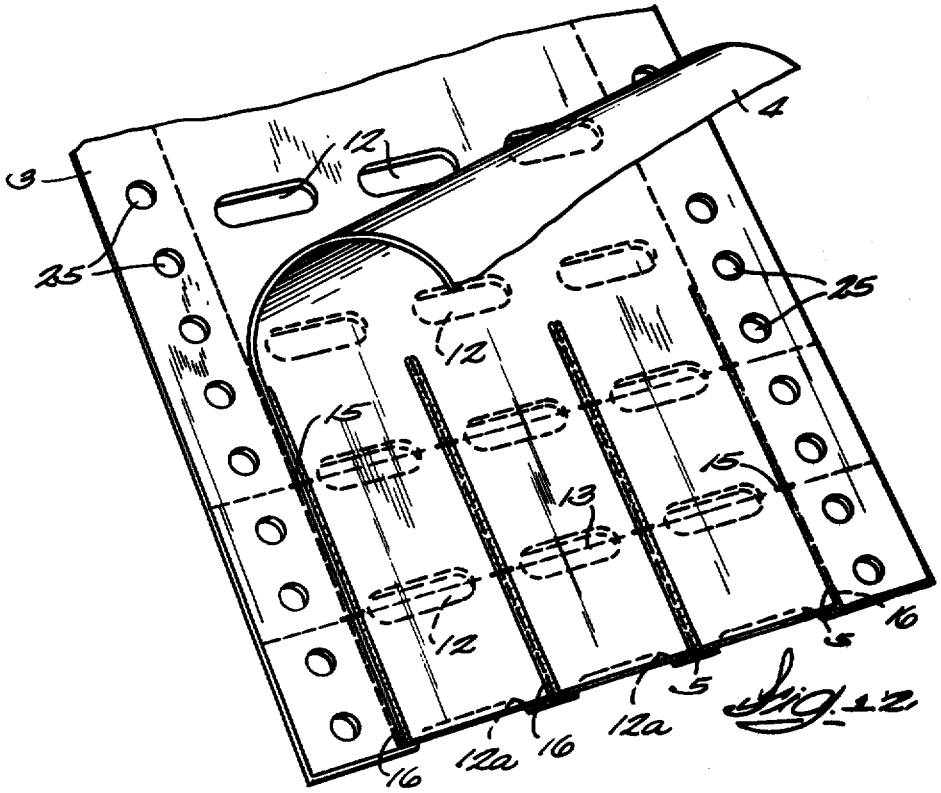
FIG. 12 is a schematic view depicting steps in a process for the manufacture of the tubular sleeve assembly illustrated in FIG. 1.

FIG. 12 schematically represents a sequence of steps which may be employed to manufacture the assemblies of sleeve markers illustrated in FIGS. 1–11.

The web 3 is unwound from a suitable supply roll and advanced in a longitudinal direction through appropriate die cutting apparatus to form the apertures 25 and the apertures 12; the two sets of apertures may be formed simultaneously or sequentially. The web 4 is thereafter fed into position and longitudinal seams 5 are formed to join the two webs together. The longitudinal separation lines 16 are preferably made simultaneously with the formation of the longitudinal seams, or they may be cut shortly after the seams have been formed. Lastly, transverse severance lines 13 are cut through the webs 3 and 4 to define the rows of individual sleeve markers. The finished assembly is then advanced to suitable equipment for conversion into the finally desired form, i.e. roll, sheet or fan-fold assembly.

This method provides a convenient process for manufacturing the assemblies of sleeve markers and minimizes the requirements for accurate registry of two separate webs of flexible film material.

Industrial Applicability

The assemblies of sleeve markers described above can be used in any industrial application in which a tubular sleeve marker is required in order to provide identification information. Typical uses for the sleeve markers include the identification of individual electrical wires in harnesses such as employed in the aerospace industry, identification of wires assembled in electrical panels, identification of wires in the appliance industry, and wire identification in the shipbuilding and electrical construction fields. The sleeves also may be used for identification of other cylindrical articles such as pipes, conduits and rods.

The assemblies of sleeve markers described above which utilize longitudinal seams to join together two webs in order to form the assembly possesses several unique advantages. Firstly, the use of longitudinal seams in the described manner allows the assembly to be made with only two webs of film and yet provides the capability of forming several rows of individual sleeve markers across the assembly. Thus, the drawings illustrate assemblies having three rows of sleeve markers; it is possible to have any desired number of rows (e.g. only one row or two or more rows of markers) depending on the final size required for the assembly and the sizes of the individual sleeve markers. Another advantage of the longitudinal seam construction is that it facilitates the ability to use mechanical fastening systems to join the two webs together, such as the stitched seam construction illustrated in FIGS. 10 and 11. This type of seam structure is difficult, and perhaps impractical, to use when employing transverse seams to join the webs together. An advantage of the mechanically fastened longitudinal seams such as the stitched seams of FIGS. 10 and 11 is that the assemblies can be made of the highly heat resistant film materials which cannot normally be seamed together by sonic sealing or heat sealing. This feature extends the range of materials from which the assembly can be made and provides the end user with sleeve markers of flexible film material that are suitable for more rigorous conditions such as high temperature.

The assemblies of tubular sleeve markers disclosed above also provide a number of useful advantages to the users of the assembly. The assemblies can be supplied either as flat sheets, rolls or fan-folded articles, whichever is most suitable for a particular end use. The assemblies can be advanced through various types of programmable typewriters, word processing equipment, line printers associated with computers, hot stamping equipment, etc., so that an end user can apply selected serialized or other suitable identification indicia to the individual sleeve markers of an assembly. This can be accomplished with little or no mechanical modifications to either typewriters, line printers or other types of printing equipment. The assemblies can be made of many types of flexible sheet materials, so that end users can have selected combinations tailored to be appropriate for various types of environments. For example, the sheet materials can be selected to be appropriate for exposure to particular thermal conditions, specified liquids, or other ambient conditions. Furthermore, an end user is provided with a tubular sleeve marker system that is cost effective inasmuch as the assemblies of this invention can be supplied at a significantly lower cost than some of the other tubular marker systems currently available on the market that are adapted for printing of identification indicia by the end user.

Three specific embodiments of the present invention have been described above and illustrated in the drawings in order to fully teach its concepts to those skilled in the art, it is expected that the variations in the illustrated structures can be devised by those of ordinary skill in the art which will remain within the scope of the present invention. For example, the assemblies illustrated in FIGS. 1–12 include an aperture 12 formed at each end of an individual sleeve marker; if desired, the apertures 12 can be formed at only one end of a sleeve marker. Further, the apertures 12 are illustrated as being formed in the web 3 of the assembly, but they may be formed in the web 4 or in both webs. Also, the web 4 is illustrated as being narrower in width than the web 3, but both webs may be of the same width is so desired. It is to be understood that it is intended to cover all changes and modifications in the examples of this invention herein chosen for the purpose of illustration which do not constitute a departure from the true spirit and scope of this invention.

I claim:

1. In an assembly of sleeve markers comprising webs of flexible sheet material and means defining individual tubular sleeve markers that are manually detachable from the assembly, the improvement wherein:

(1) the assembly is made with two webs arranged in face-to-face relationship and having longitudinal axes disposed parallel to one another;

(2) the means defining individual sleeve markers consist of longitudinal seams joining the two webs together and transverse severance lines extending across the webs, (a) there being a plurality of spaced longitudinal seams in the assembly, and (b) there being a plurality of spaced transverse severance lines, with each transverse severance line extending at least between the outermost longitudinal seams in the assembly, (3) spaced rows of transverse apertures defined in at least one of the webs and extending transversely across the assembly, there being at least one transverse aperture for each individual sleeve marker, with each row of transverse apertures being positioned to be intersected by a transverse severance line; and (4) a longitudinal separation line extending along each longitudinal seam;

an individual sleeve marker being manually detachable from the assembly along the transverse severance lines and longitudinal separation lines, each individual sleeve marker having opposed closed edge portions defined by parts of an adjacent pair of longitudinal seams and opposed open end portions defined by parts of an adjacent pair of transverse severance lines and having a portion of a transverse aperture along at least one of its open ends.

2. An assembly of sleeve markers according to claim 1 in which:

one of the webs is wider than the other web to have a pair of opposed longitudinal marginal edge portions extending beyond longitudinal edges of the other web, and a row of spaced apertures is formed in said one web within each longitudinal marginal edge portion for engagement with sprocket web transport apparatus.

3. An assembly of sleeve markers according to claim 1, in which:

each transverse severance line comprises a plurality of spaced slits cut through the two webs, including one slit for each longitudinal seam and extending thereacross.

4. An assembly of sleeve markers according to claims 1, 2 or 3 in which:

the longitudinal seams consist of ultrasonically sealed portions of the two webs, and a longitudinal separation line extends centrally of each said seam.

5. An assembly of sleeve markers according to claims 1, 2 or 3, in which:

the longitudinal seams consist of rows of thread stitching the two webs together, (a) there being one row of thread in the two outer seams of the plurality of longitudinal seams and a longitudinal separation line positioned outboard of each row of thread, and (b) there being two spaced rows of thread in each interior longitudinal seam of the assembly and a longitudinal separation line positioned therebetween.

6. An assembly of sleeve markers according to claims 1, 2 or 3 in which:

the longitudinal seams consist of heat sealed portions of the two webs, and a longitudinal separation line extends centrally of each said seam.

* * * * *